US005099949A

United States Patent [19]

Mitobe

[11] Patent Number: 5,099,949

[45] Date of Patent: Mar. 31, 1992

[54] SPEAKER AND MANUFACTURING METHOD THEREFOR

[75] Inventor: Kunio Mitobe, Yamagata, Japan

[73] Assignee: Pioneer Electronic Corporation, Tokyo, Japan

[21] Appl. No.: 489,317

[22] Filed: Mar. 5, 1990

[30] Foreign Application Priority Data

Mar. 30, 1989 [JP] Japan ..... 1-81145

[51] Int. Cl.[5] ..... H04R 7/16

[52] U.S. Cl. ..... 181/171; 181/172; 381/188; 381/193; 381/205

[58] Field of Search ..... 181/171, 172, 148; 381/187, 188, 193, 194, 197, 205

[56] References Cited

U.S. PATENT DOCUMENTS

| | | | |
|---|---|---|---|
| 4,190,746 | 2/1980 | Harwood et al. | 381/194 X |
| 4,384,174 | 5/1983 | Suzuki, et al. | 381/194 X |
| 4,517,416 | 5/1985 | Goossens | 381/194 X |
| 4,520,237 | 5/1985 | Murakama | 381/194 |

*Primary Examiner*—Benjamin R. Fuller
*Assistant Examiner*—Victor DeVito
*Attorney, Agent, or Firm*—Sughrue, Mion, Zinn, Macpeak and Seas

[57] ABSTRACT

A speaker and manufacturing method therefor includes a diaphragm having an integral edge, first and second frame pieces and a driver unit. The first and second frame pieces are formed by molding so that the first frame piece is integrally combined with the diaphragm edge, and the second frame piece is integrally combined with the driver unit.

6 Claims, 2 Drawing Sheets

SPEAKER AND MANUFACTURING METHOD THEREFOR

The present invention relates to a speaker and a method for manufacturing same. More particularly, the invention relates to a speaker in which constituent members, made of resin, are combined with each other through a bonding step and a manufacturing method therefor.

BACKGROUND OF THE INVENTION

Most known speakers have a configuration such that a cone-type diaphragm is supported at its periphery by a metal speaker frame through an edge, and one end of a bobbin, having a voice coil previously wound thereon, is adhesively fixed to the diaphragm at its inner periphery. The diaphragm, & etc. are attached to a separately assembled driver unit constituted by a center pole, a yoke, a magnet, and a top plate so that the voice coil is located in an air gap of the driver unit, and a damper for supporting the bobbin is fixed to the speaker frame.

Such a speaker is generally assembled with seven or eight pieces, and those constituent members are manufactured in various manufacturing steps which are different from each other. For example, a diaphragm is obtained by paper-molding of a pipe material, an edge is obtained through plastic working on a cloth base coated with a filling-up material or the like, and a speaker frame is molded through pressing or casting.

Such speakers as described above have problems in that constituent members manufactured in separate manufacturing steps respectively are assembled in a predetermined order, so that separate steps equal in number to the constituent members are required. The number of such constituent parts is large, and the cost is high because of the complexity in operation and control.

SUMMARY OF THE INVENTION

It is therefore an object of the present invention to reduce the number of constituent members and to make it possible to assemble the constituent members in a manufacturing process so that the manufacturing cost is reduced and the quality is uniform.

In order to attain the above object, the speaker manufacturing method according to the present invention comprises the steps of: a first step of insertion-molding an edge to a diaphragm; a second step of molding a first frame piece for supporting a periphery of a vibrating member obtained in the first step; a third step of molding a speaker frame for supporting the first frame piece on a driver unit obtained by assembling a magnet, a plate, etc. onto a yoke having a center pole; and a fourth step of adhesively assembling the vibrating member obtained in the second step and the driver unit obtained in the third step and bonding one and the other end edges of a damper to the speaker frame and to a voice coil bobbin integrally combined with the diaphragm respectively.

In the first step, a previously molded diaphragm is inserted into a mold for forming an edge, and resin is injected into a cavity of the edge so as to obtain a first constituent member in which the diaphragm and the edge are integrally combined with each other.

In the second step, a speaker frame (second constituent member in which a packing portion and a rim portion are integrally combined) for supporting the first constituent member at its periphery is molded, and at the same time, the first and second constituent members are integrally combined with each other.

In the third step, which is independent of and carried out in parallel to the second step and so on, a magnet and a top plate are combined with a center pole having a yoke to obtain a third constituent member, and a resin is injected into a second piece cavity of the speaker frame in the mold in which the third constituent member is inserted, so that a second piece is integrally molded.

In the fourth step, the moldings in the second and third steps are combined with each other, a damper and a bobbin on which a voice coil is wound are incorporated, and the constituent members are finally integrally combined with each other through an adhesive.

DETAILED DESCRIPTION OF THE PREFERRED EMBODIMENT

Figure 1:
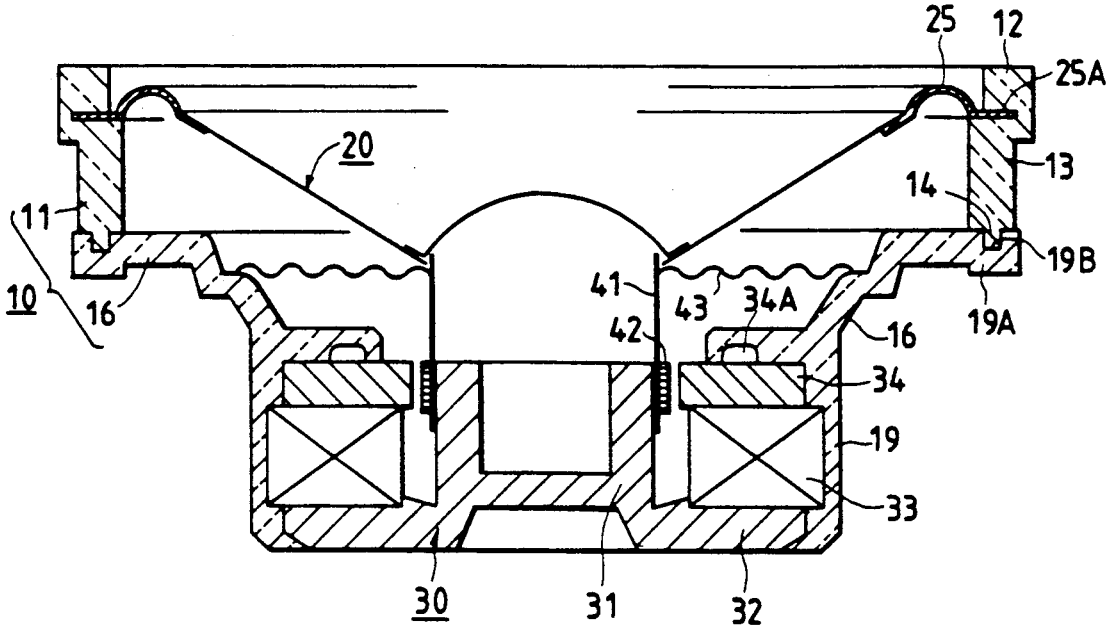
FIG. 1 is a side sectional view of the speaker unit according to the present invention.

Referring to the accompanying drawings, an embodiment of the present invention will now be described. FIG. 1 is a side sectional view of the speaker according to the present invention. As shown in FIG. 1, the reference numeral 10 designates a speaker frame. The speaker frame 10 is constituted by two pieces 11 and 16 which are molded with resin.

Figures 2A, 2B, 2C:
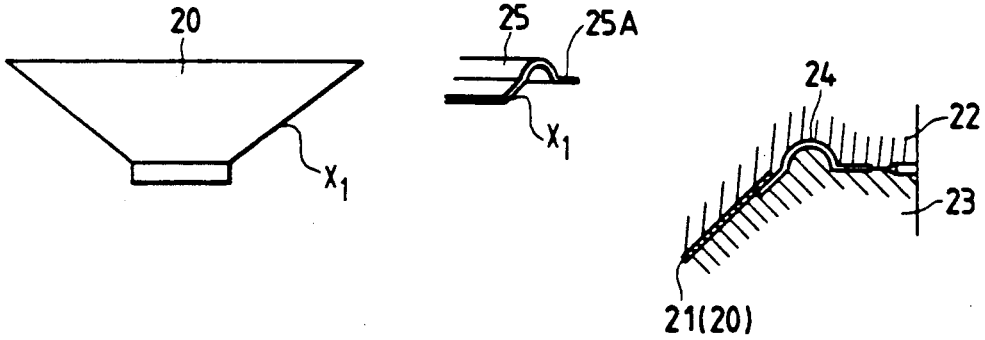
FIGS. 2(A), 2(B) and 2(C) are sectional views of a diaphragm, an edge, and a mold for forming the edge, respectively.

Referring to FIGS. 2(A)-2(C), the reference numeral 20 designates a cone-type diaphragm. An upper mold 22 and a lower mold 23 for forming a diaphragm cavity 21 are combined with each other to form an edge cavity 24. After the diaphragm 20 is inserted into the edge cavity 24, resin which will become an edge 25 is injected into the edge cavity 24. Thus, as shown in FIG. 3(A), a first constituent member X1 in which the diaphragm 20 and the edge 25 are integrally combined with each other is obtained (the first step).

The periphery of the edge 25 of the first constituent member X1 is fixed to the speaker frame 10. The speaker frame 10 is however divided into the first and second members 11 and 16, respectively, (FIG. 1), and it is the first member 11 that supports the edge 25. As shown in FIG. 3(B), the first member 11 of the speaker frame 10 is constituted by a packing portion 12 and a rim portion 13 which are integrally combined with each other. The packing portion 12 has a diameter larger than that of the rim portion 13. The rim portion 13 has a stage portion 13A at a boundary between the rim portion 13 and the packing portion 12 and has a slit 13B so that the edge 25 can be inserted on the outer periphery of the slit 13B. A projecting annular portion 14 for integrally combining the rim portion 13 and the second piece 16 (which will be described later) is formed on the end surface of the rim portion 13.

Holes are formed in a flange portion 25A (FIG. 2(B) of the edge 25 so as to integrally combine the first frame piece 11 and the edge 25. The first frame piece 11 is injection-molded as will be described later. The provision of the holes is effective in the case of an edge made of resin in a group of polypropylene.

Figures 3A, 3B, 3C:
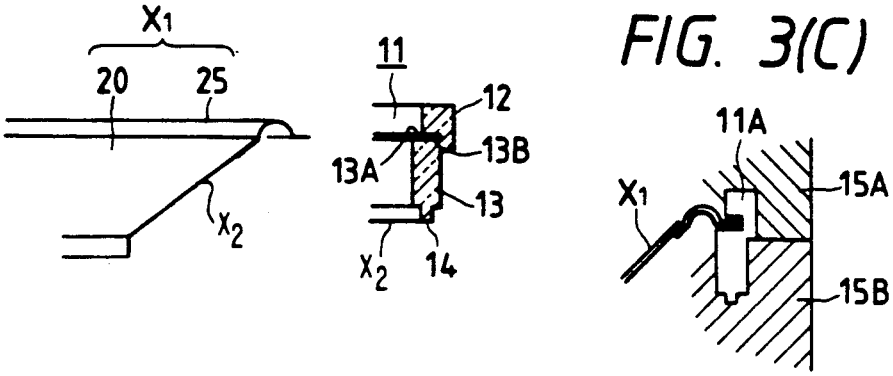
FIGS. 3(A) and 3(B) are views for explaining the second constituent member.
FIG. 3(C) is a sectional view of the forming mold.

Referring to FIGS. 3(B) and 3(C), the first piece 11 is molded as a second constituent member X2 by injecting resin into a first piece cavity 11A formed in the molds 15A and 15B in which the first constituent member X; is inserted (the second step).

Figure 4A:
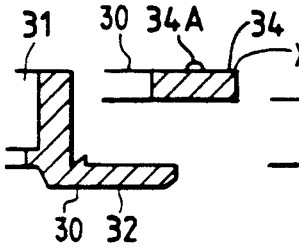
FIGS. 4(A) and 4(B) are views for explaining the third constituent member.

As shown in FIG. 4(A), a center pole 31 is integrally formed with a yoke 32, and a driver unit 30 is constituted by assembling a magnet 33, a top plate 34, the center pole 31 and the yoke 32 (the third step).

Figure 4B:
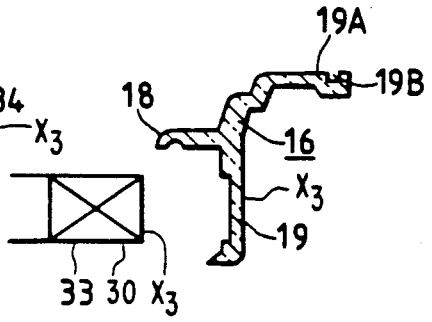
Figure 4C:
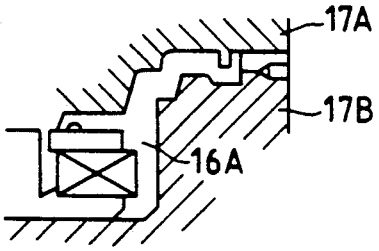
FIG. 4(C) is a sectional view of the forming mold.

By insertion of the driver unit 30, a second piece cavity 16A (FIG. 4(C)) for molding the second piece 16 is formed by molds 17A and 17B. When resin is injected into the second piece cavity 16A, the driver unit 30 and the second piece 16 are integrally combined with each other so that the third constituent member X1 (FIG. 5(B)) is obtained particularly in the state in which the second piece 16 is fitted to protrusions 34A of the top plate 34 (the fourth step).

As shown in FIG. 4(B), the second piece 16 is obtained in the fourth step and is provided with an engaging edge 18 for catching the top plate 34 and a rim portion 19 for engaging the yoke 32 and for catching the respective peripheries of the magnet 33 and the periphery of the top plate 34. A radially extending flange portion 19A is provided on the rim portion 19 at its upper end outer periphery. A concave annular portion 19B is formed in the flange portion 19A so that the projecting annular portion 14 of the first piece 11 is fitted into the concave annular portion 19B.

Figure 5A:
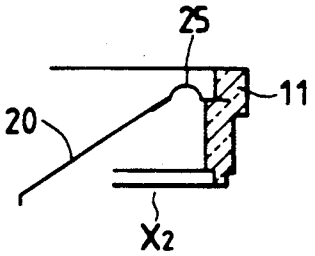
FIGS. 5(A), 5(B), 5(C) and 5(D) are explanatory views showing the second constituent member, third constituent member, a damper, and a bobbin on which a voice coil is wound, respectively.
Figure 5B:
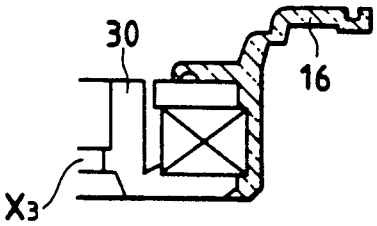
Figure 5C:
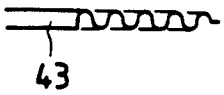
Figure 5D:
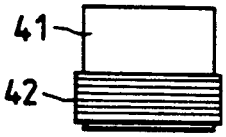

The second constituent member X2 and the third constituent member X1 are assembled (FIG. 5(A)), and at the same time, a voice coil bobbin 41 on which a voice coil 42 is wound is fixed to the diaphragm 20, and the inner periphery of a damper 43 (FIG. 5(C)) is fixed to the voice coil bobbin 41 (FIG. 5(D)) attached to the diaphragm 20 (FIG. 1), and the outer periphery of the damper 43 is fixed (adhesively bonded) to the second piece 16 of the speaker frame 10.

In the speaker and method therefor according to the present invention, the speaker unit can be roughly divided into three constituent members, so that the assembling work can be simplified so as to be carried out efficiently and inexpensively, and each of the constituent members can be molded with resin through insertion-molding. In other words, the constituent member at the outer peripheral portion is insertion-molded on the constituent member at the central portion, so that the step for combining or adhering the constituent members is omitted, thereby reducing the manufacturing cost.

Further, the constituent members, except the driver unit, are injection-molded with resin, so that there is little scattering in quality and performance.

What is claimed is:

1. A speaker comprising:

a diaphragm having a voice coil and an integral edge;

a first frame piece for supporting the edge of the diaphragm;

a driver unit for driving said diaphragm, said driver unit including a top plate having a protrusion;

a second frame piece for supporting the first frame piece and being integrally formed with the driver unit, said second frame piece having an engaging edge for engaging said top plate including said protrusion.

2. The speaker as defined in claim 1, wherein said first frame piece includes a projection, and said second frame piece includes a flange for receiving the projection.

3. The speaker as defined in claim 1, wherein said first frame piece includes a packing portion and a rim portion.

4. The speaker as defined in claim 3, wherein said packing portion has a diameter which is larger than a diameter of said rim portion, and said rim portion has a stage portion at a boundary between said rim portion and said packing portion.

5. The speaker as defined in claim 1, wherein said first frame piece includes a slit so that said edge can be inserted in an outer periphery of the slit.

6. The speaker as defined in claim 1, wherein said driver unit further includes yoke, and said second frame piece further includes a rim portion for engaging the yoke.

* * * * *